US011459747B2

(12) United States Patent
Flint et al.

(10) Patent No.: US 11,459,747 B2
(45) Date of Patent: Oct. 4, 2022

(54) WEEP HOLE INSERT

(71) Applicants: John Noel Flint, West End (AU); Lynne Patricia Oldfield, West End (AU)

(72) Inventors: John Noel Flint, West End (AU); Lynne Patricia Oldfield, West End (AU)

( * ) Notice: Subject to any disclaimer, the term of this patent is extended or adjusted under 35 U.S.C. 154(b) by 0 days.

(21) Appl. No.: 17/254,021

(22) PCT Filed: Jun. 19, 2019

(86) PCT No.: PCT/AU2019/050629
§ 371 (c)(1),
(2) Date: Dec. 18, 2020

(87) PCT Pub. No.: WO2019/241839
PCT Pub. Date: Dec. 26, 2019

(65) Prior Publication Data

US 2021/0262223 A1 Aug. 26, 2021

(30) Foreign Application Priority Data

Jun. 19, 2018 (AU) ..... 2018902177

(51) Int. Cl.
*E04B 1/72* (2006.01)
*E04B 1/70* (2006.01)
*E04B 1/94* (2006.01)

(52) U.S. Cl.
CPC ..... *E04B 1/7053* (2013.01); *E04B 1/72* (2013.01); *E04B 1/947* (2013.01)

(58) Field of Classification Search
CPC ..... E04B 1/7053; E04B 1/7076; E04B 1/72; E04B 1/7069; E04B 1/947
See application file for complete search history.

(56) References Cited

U.S. PATENT DOCUMENTS 6,176,048 B1 1/2001 Berger
7,128,643 B2 * 10/2006 Beliveau ..... F24F 13/085 454/276

(Continued)

FOREIGN PATENT DOCUMENTS

WO 2009003230 A1 1/2009

OTHER PUBLICATIONS

Mohammed et al. 2016, "Temperature and heat flux measurement techniques for aeroegine fire test; a review" IOP Conference Series: Material Science and Engineering, 152 (2016) 012036.

(Continued)

*Primary Examiner* — Babajide A Demuren
*Assistant Examiner* — Daniel J Kenny

(57) ABSTRACT

Weep hole insert (10, 10) comprising a tubular body (12) defining an air flow conduit (14) extending therethrough, along axis (L), from a first open end (12*a*) to a second open end (12*b*) of the body. Grate (16) comprises a perforated body (16*a*) configured to permit air flow but to inhibit passage of embers and sparks. In an operative configuration, perforated body (16*a*) extends across the conduit (14). Elastically compressible member (16*c*) is engageable between perforated body (16*a*) and an interior surface of body (12) to releasably secure the perforated body in the operative configuration. When engaged between body (16*a*) and the interior surface of body (12), member (16*c*) is elastically compressed from an expanded configuration to a compressed configuration by a distance of at least a wall thickness (T) of body (12) at its point of engagement by member (16*c*).

19 Claims, 7 Drawing Sheets

(56) References Cited

U.S. PATENT DOCUMENTS

| | | | | |
|---|---|---|---|---|
| 9,903,108 | B2 | 2/2018 | Flint et al. | |
| 2008/0276556 | A1 | 11/2008 | Flint et al. | |
| 2009/0019793 | A1* | 1/2009 | Huber, Jr. | E04B 1/70 52/101 |

OTHER PUBLICATIONS

International Sear Report and Written Opinion for Application No. PCT/AU2019/050629 received Aug. 9, 2019.

* cited by examiner

WEEP HOLE INSERT

CROSS-REFERENCE TO RELATED APPLICATIONS

The present application claims priority from Australian Provisional Patent Application No 2018902177 filed on 19 Jun. 2018, the contents of which are incorporated herein by reference in their entirety.

TECHNICAL FIELD

The present disclosure relates to an insert for a weep hole opening in a wall, such as a masonry wall, and embodiments thereof will be described hereinafter with reference to this application. However, the insert is not limited to this application and may also be used, for example, in rendered polystyrene or other light weight panel cavity walls, underfloor vents, retaining walls and tilt-up concrete walls.

BACKGROUND

In cavity brick or block masonry construction, weep hole openings are left in mortar joints just above the flashing to allow both ventilation and drainage of the wall cavity between the exterior masonry and the interior wall. A weep hole opening is typically formed by the omission of mortar between two adjacent bricks or blocks. The weep hole opening provides ventilation and drainage to keep the wall cavity dry. Without adequate ventilation, dampness causes mildew and rot, which reduce the life of the structure.

Weep hole openings vary considerably in size and shape dependent on the skill and care of the tradesmen and the type of brick and type of finishes being applied. A problem with weep hole openings situated close to ground level, as are common, is that they can become an entry for rodents and reptiles. Similarly, a problem with weep hole openings around windows or second floors is that they can provide an entry for insects; in particular, the weep hole opening leading to the wall cavity is an ideal home for bees, wasps and other insects, which themselves create food sources for other pests. Another problem associated with weep hole openings is that they provide an entry point for water, particularly during excessive rain or from garden sprinklers. Another problem with weep hole openings is that they can allow sparks and embers to penetrate a building.

A number of attempts have been made to solve some of the above problems.

For example, U.S. Pat. No. 4,102,093 (Harris) discloses forcing a perforated sheet of aluminium into the weep hole opening and then using a special tool to deform the sheet to the shape of the opening.

The present applicants' earlier Australian Patent No. 713335, the entire disclosure of which is incorporated herein by reference, discloses a weep hole device including a hollow plastic body for engagement in a weep hole opening. A removable cover is provided over one end of the body to prevent mortar clogging the body during rendering. The cover is removed after rendering is complete and a vermin-proof grate is fitted onto the end of the body in its place. However, a problem with this device is that the grate cannot be installed until after rendering is complete and it is common for tradesmen to misplace the grate.

A problem with known weep hole devices, such as those mentioned above, is that they can fail as a result of being exposed to high temperatures, for example during bushfires. The failure can occur as a result of the weep hole device igniting and disintegrating, or due to the device melting, thereby allowing embers and sparks, as well as vermin and insects, to enter the wall cavity.

To address this problem, the present applicants developed the weep hole device disclosed in International Patent Application No. PCT/AU2007/000004 (Publication No. WO2007/092985), the entire disclosure of which is incorporated herein by reference. Embodiments of this device have been found to perform very well.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

Throughout this specification the words "comprise" and "include", and variations such as "comprises", "comprising", "includes" and "including", will be understood to imply the inclusion of a stated element, integer or step, or group of elements, integers or steps, but not the exclusion of any other element, integer or step, or group of elements, integers or steps.

SUMMARY

Disclosed herein is an insert for a weep hole opening in a wall, said weep hole insert comprising:

a generally tubular body defining an air flow conduit extending therethrough, along a first axis, from a first open end of the body to a second open end of the body;

a grate comprising a perforated body, wherein apertures of the perforated body are configured to permit air flow through the grate but to inhibit passage of embers and sparks through the grate, and wherein, in an operative configuration, the perforated body extends across the conduit to permit air flow through the conduit but to inhibit passage of embers and sparks through the conduit; and at least one elastically compressible member for engagement between the perforated body and an interior surface of the tubular body to releasably secure the perforated body to the perforated body in the operative configuration, wherein, when engaged between the perforated body and the interior surface of the tubular body, the elastically compressible member is elastically compressed from an expanded configuration to a compressed configuration by a distance of at least a wall thickness of the tubular body at its point of engagement by the elastically compressible member, and wherein, when exposed to a temperature above a melting point of material from which the tubular body is formed, the elastically compressible member maintains sufficient elasticity to elastically return to the expanded configuration.

When exposed to a predetermined heat flux profile, the elastically compressible member may maintain sufficient elasticity to elastically return to the expanded configuration. The predetermined heat flux profile may approximate a heat flux profile generated by a forest fire. The predetermined heat flux profile may comprise radiant heat flux up to but not exceeding a predetermined value, such as:

radiant heat flux up to but not exceeding 12.5 $kW/m^2$;

radiant heat flux up to but not exceeding 19 $kW/m^2$;

radiant heat flux up to but not exceeding 29 $kW/m^2$; or radiant heat flux up to but not exceeding 40 $kW/m^2$.

The grate may be hingedly connected to the tubular body and movable between a closed configuration, being the operative configuration in which the perforated body extends across the conduit, and an open configuration for facilitating inspection of the conduit. The tubular body may include an abutment surface that is engaged upon movement of the grate into the closed position, the abutment surface thereby defining the operative/closed configuration. Frictional or mechanical engagement between the grate and the tubular body may releasably retain the grate in the closed configuration and/or in the open configuration. For example, in some embodiments, the at least one elastically compressible member may comprise a projection engageable with a recess in the tubular body to releasably retain the grate in the closed configuration and, in other embodiments, the tubular body may comprise a projection engageable with a recess in the at least one elastically compressible member to releasably retain the grate in the closed configuration.

The grate may comprise the perforated body and the elastically compressible member. The perforated body and the elastically compressible member may be of integral, one-piece construction. The elastically compressible member may comprise a resilient tab extending from a periphery of the perforated body. The perforated body may comprise a substantially oblong sheet or plate. At least one reinforcing formation may extend along a major axis of the perforated body to strengthen the perforated body against bending. The at least one reinforcing formation may comprise two reinforcing formations, each extending along a respective edge of the perforated body. An intermediate portion of the resilient tab may engage the at least one reinforcing formation during movement of the resilient tab from the expanded configuration to the compressed configuration. The intermediate portion of the resilient tab may engage the at least one reinforcing formation before the resilient tab adopts the compressed configuration, so as to increase the compressive resistance of the resilient tab thereafter.

An angle defined between a major axis of the perforated body and a distal end of the elastically compressible member may be greater than 90 degrees.

The at least one elastically compressible member may comprise a plurality of elastically compressible members, each being associated with a respective edge of the perforated body.

The apertures of the perforated body may have a maximum dimension of 2 mm. The grate and the elastically compressible member may be formed from corrosion-resistant metal, such as steel, bronze or aluminium. In some embodiments, the grate and the elastically compressible member may be formed from stainless steel, such as SS316 grade stainless steel.

A cap may be removably engageable with an end of the tubular body, outboard of the grate, to close the conduit and cover the perforated body during rendering. With the cap in place, an outer surface of the cap may be flush with the end of the tubular body. The cap may be removably engaged with the tubular body directly and/or via the grate.

The tubular body may be formed from a plastics material. The plastics material may comprise a flame retardant material and/or a pesticide. The plastics material may comprise polypropylene.

Other inventions may also be disclosed herein and comprise any combination of steps, features, integers, compositions and/or compounds disclosed in this specification, regardless of whether such disclosure is by words or by illustration in the drawings.

BRIEF DESCRIPTION OF DRAWINGS

A weep hole insert embodying principles disclosed herein will now be described, by way of example only, with reference to the accompanying drawings, in which.

DESCRIPTION OF EMBODIMENTS

Figure 1:
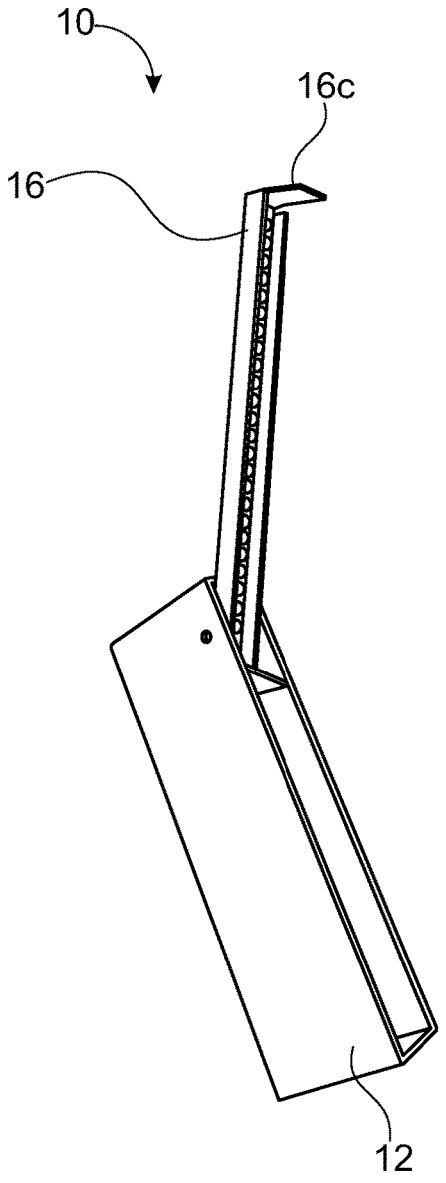
FIG. 1 is a perspective view of a weep hole insert embodying principles disclosed herein, showing the grate in an open configuration and without its cap in place.
Figure 2:
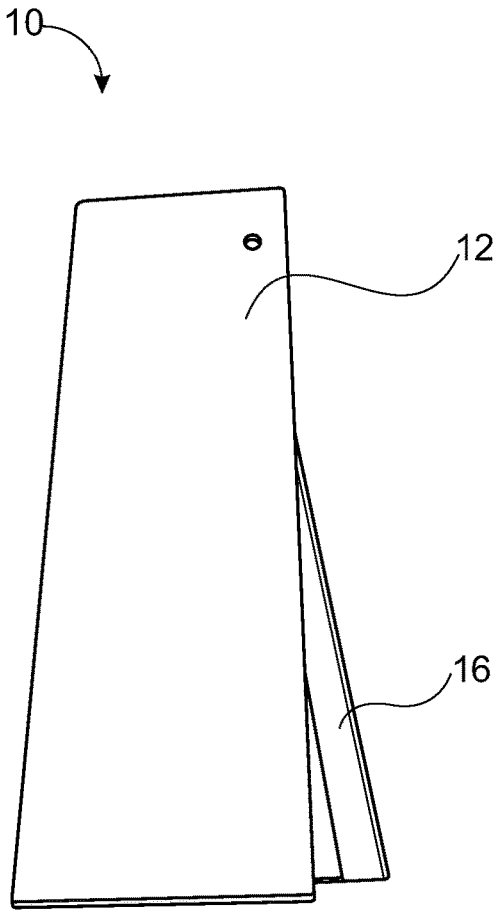
FIG. 2 is a perspective view of the weep hole insert of FIG. 1, showing the grate in an almost closed configuration and without its cap in place.
Figure 3:
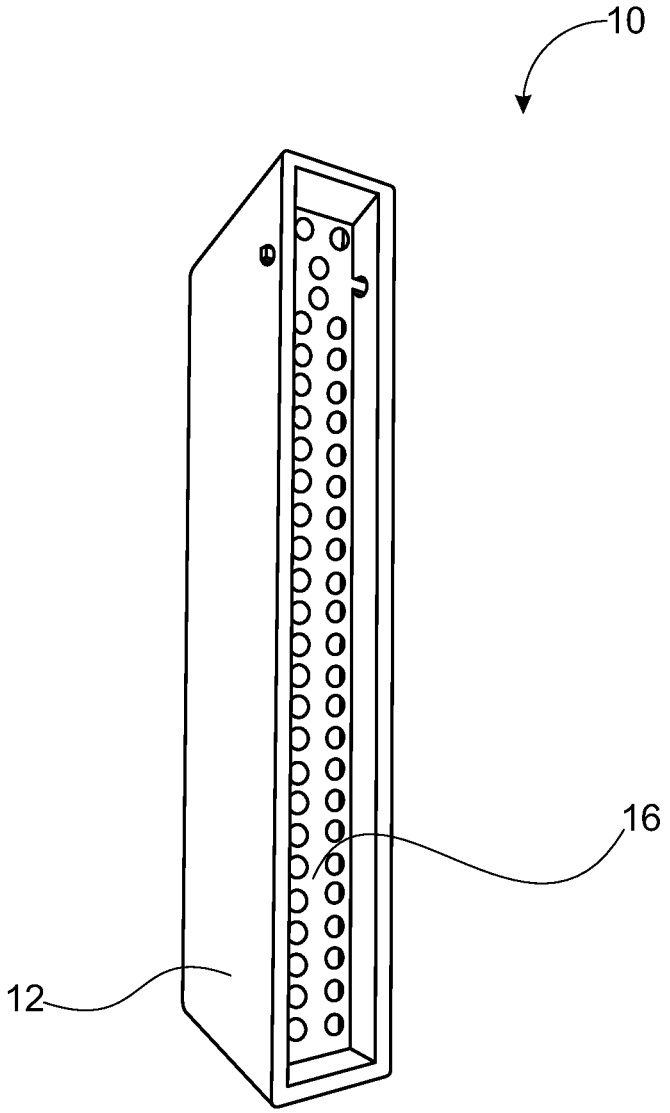
FIG. 3 is a perspective view of the weep hole insert of FIG. 1, showing the grate in a closed configuration and without its cap in place.
Figure 4:
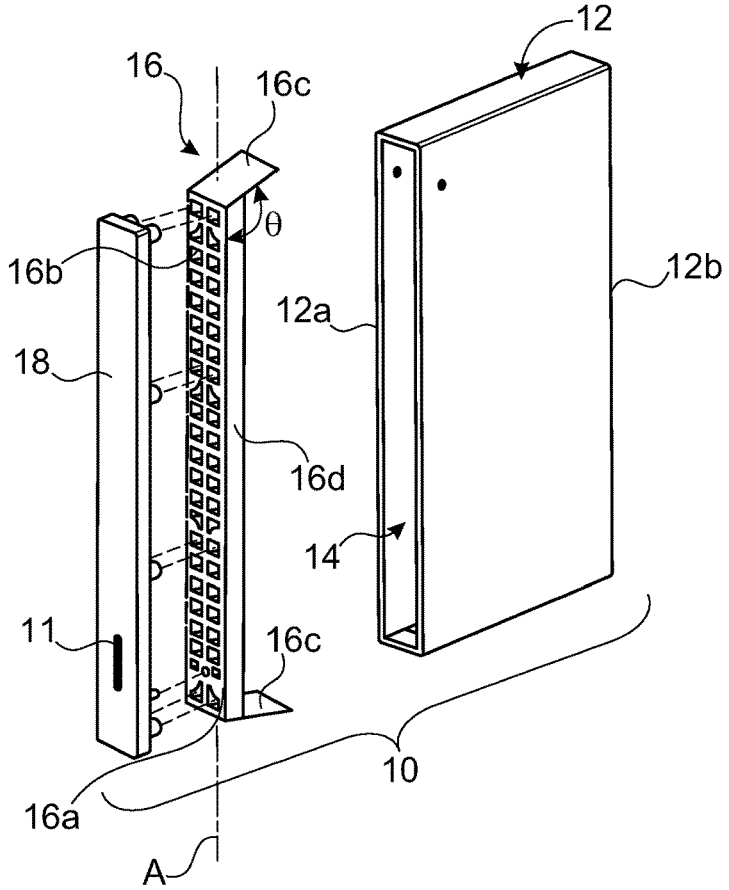
FIG. 4 is an exploded perspective schematic view of the weep hole insert of FIG. 1, including its cap.
Figure 5:
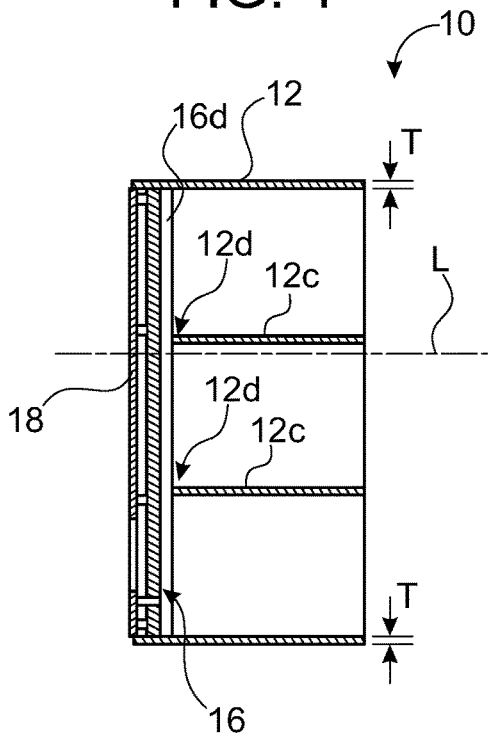
FIG. 5 is a longitudinal cross-sectional schematic view taken vertically through the weep hole insert of FIG. 1, showing the grate in a closed configuration and with its cap in place.

Referring initially to FIGS. 1-5, of the drawings, there is shown a first embodiment of an insert for a weep hole opening in a masonry wall. The weep hole insert 10 comprises a generally tubular body 12 defining an air flow conduit 14 extending therethrough, along a first axis L, from a first open end 12*a* of the body to a second open end 12*b* of the body. A grate 16 comprising a perforated body 16*a*, having apertures 16*b* configured to permit air flow through the grate, but to inhibit passage of embers and sparks, is provided. In an operative configuration, the perforated body 16*a* extends across the conduit 14 to permit air flow through the conduit but to inhibit passage of embers and sparks through the conduit. At least one, and in the illustrated embodiment two, elastically compressible member 16*c* is provided for engagement between the perforated body 16*a* and an interior surface of the tubular body 12 to releasably secure the perforated body in the operative configuration. When engaged between the perforated body 16*a* and the interior surface of the tubular body 12, the elastically compressible member 16*c* is elastically compressed from an expanded configuration, as shown in FIGS. 1 and 4, to a compressed configuration, as shown in FIGS. 2, 3 and 5, by a distance of at least a wall thickness T of the tubular body 12 at its point of engagement by the elastically compressible member 16*c*. In the expanded configuration, an angle θ defined between major axis A of the perforated body and a distal end of the elastically compressible member is greater than 90 degrees.

In some embodiments, the elastically compressible member 16*c* and tubular body 12 are configured such that, when exposed to a temperature above a melting point of material from which the tubular body is formed, the elastically compressible member maintains sufficient elasticity to elastically return to the expanded configuration as shown in FIGS. 1 and 4.

In some embodiments, the elastically compressible member 16*c* and tubular body 12 are configured such that, when exposed to a predetermined heat flux profile, the elastically compressible member maintains sufficient elasticity to elastically return to the expanded configuration as shown in FIGS. 1 and 4. When insert 10 is used in bushfire/forest fire prone areas, the predetermined heat flux profile may approximate a heat flux profile associated with a bushfire/forest fire. In some embodiments, the predetermined heat flux profile comprises radiant heat flux up to but not exceeding 29 $kW/m^2$. In other embodiments, however, the predetermined heat flux profile may comprise radiant heat flux up to but not exceeding a different value, such as up to but not exceeding 12.5 $kW/m^2$, up to but not exceeding 19 $kW/m^2$, or up to but not exceeding 40 $kW/m^2$.

In the illustrated embodiment, grate 16 is hingedly connected to the tubular body 12 and movable between a closed configuration, being the operative configuration in which the perforated body extends across the conduit as shown in FIGS. 3 and 5, and an open configuration for facilitating inspection of the conduit as shown in FIG. 1. Frictional or mechanical engagement between the grate 16 and the tubular body 12 releasably retain the grate in the open configuration and in the closed configuration. For example, in some embodiments, the elastically compressible member 16*c* at the opposite end of grate 16 to its hinge comprises a projection engageable with a recess in the tubular body 12 to releasably retain the grate in the closed configuration and, in other embodiments, the tubular body 12 comprises the projection and the elastically compressible member 16*c* comprises the recess.

In the illustrated embodiment, grate 16 comprises the perforated body 16*a* and the elastically compressible member 16*c*, the perforated body and the elastically compressible member being of integral, one-piece construction. The elastically compressible member 16*c* comprises a resilient tab extending from a periphery of the perforated body 16*a*. The perforated body 16*a* takes the form of a substantially oblong sheet or plate. At least one, in the illustrated embodiment two, reinforcing formation, in the form of flanges 16*d*, extends along major axis A of the perforated body 16*a* to strengthen the perforated body against bending. Reinforcing flanges 16*d* extend along respective opposite edges of the perforated body 16*a*. An intermediate portion of each resilient tab 16*c* engages the reinforcing flanges 16*d* during movement of the resilient tab from the expanded configuration to the compressed configuration. This engagement occurs before the resilient tab 16*c* adopts the compressed configuration shown in FIGS. 2, 3 and 5, so as to increase the compressive resistance of the resilient tab thereafter.

Apertures 16*b* have a maximum dimension of 2 mm. The grate 16, including the elastically compressible member 16*c*, is formed from corrosion-resistant metal, such as steel, bronze or aluminium, in some embodiments being formed from stainless steel, such as SS316 grade stainless steel sheet having a thickness of 0.2 mm.

A mortar guard cap 18 is removably engageable with end 12*a* of the tubular body 12, outboard of the grate 16, to close the conduit 14 and cover the perforated body 16*a* during rendering of a masonry wall in which insert 10 is installed. With the cap 18 in place, as shown in FIG. 5, an outer surface of the cap finishes substantially flush with end 12*a* of the tubular body. The cap is removably engaged with the tubular body 12 directly and/or via the grate 16. Cap 18 includes a slot 11 engageable by a screwdriver or the like to facilitate its removal from the tubular body 12 when rendering is complete.

In the illustrated embodiment, the tubular body 12 is formed from polypropylene or another plastics material, which may comprise a flame retardant material and/or a pesticide. The flame retardant material used in tubular body 12 may be a halogen-free flame retardant selected to provide tubular body with a classification of V-2, V-1 or V-0 under UL 94, the Standard for Safety of Flammability of Plastic Materials for Parts in Devices and Appliances testing. In the illustrated embodiment, tubular body 12 has a UL 94 classification of V-1 and is formed from polypropylene copolymerised with a phosphorus-nitrogen containing halogen-free flame retardant.

Tubular body 12 is sized for a snug fit within a weep hole opening of the masonry wall. Tubular body 12 includes substantially planar outer surfaces to facilitate adjustment of the position of the weep hole insert 10 within the weep hole opening. Also, the omission of anchors on the exterior surface of the tubular body 12 makes it easy to remove and replace the insert 10 if it becomes unserviceable. Tubular body 12 includes internal ribs 12*c* for strengthening its sidewalls against bowing. The tubular body 12 includes an abutment surface 12*d* that is engaged upon movement of the grate 16 into the closed position, the abutment surface thereby defining the operative/closed configuration.

The grate 16 and cap 18 are pre-installed in the tubular body 12. In use, the weep hole insert 10 is placed into the weep hole opening of a wall with end 12*a* directed toward the exterior of the wall and end 12*b* directed toward the wall cavity. The cap 18 can be removed and grate 16 opened to allow the internal ribs 12*c* to be gripped by long nosed pliers to assist in accurate placement of the weep hole insert 10 in the weep hole opening. Once the insert 10 has been accurately placed, the grate 16 is closed and the cap 18 is replaced. After rendering is completed, the cap 18 is removed to expose the grate 16 and its ventilation apertures 16*b*. When used in a masonry wall, the weep hole insert 10 is typically not fixed in the weep hole opening using an adhesive, such that the position of the insert 10 can be adjusted during and after rendering. However, in some embodiments, especially when used in a rendered light weight panel wall, the weep hole insert 10 may be fixed in the weep hole opening, for example by providing an adhesive between the exterior of tubular body 12 and walls of the weep hole.

Figure 6:
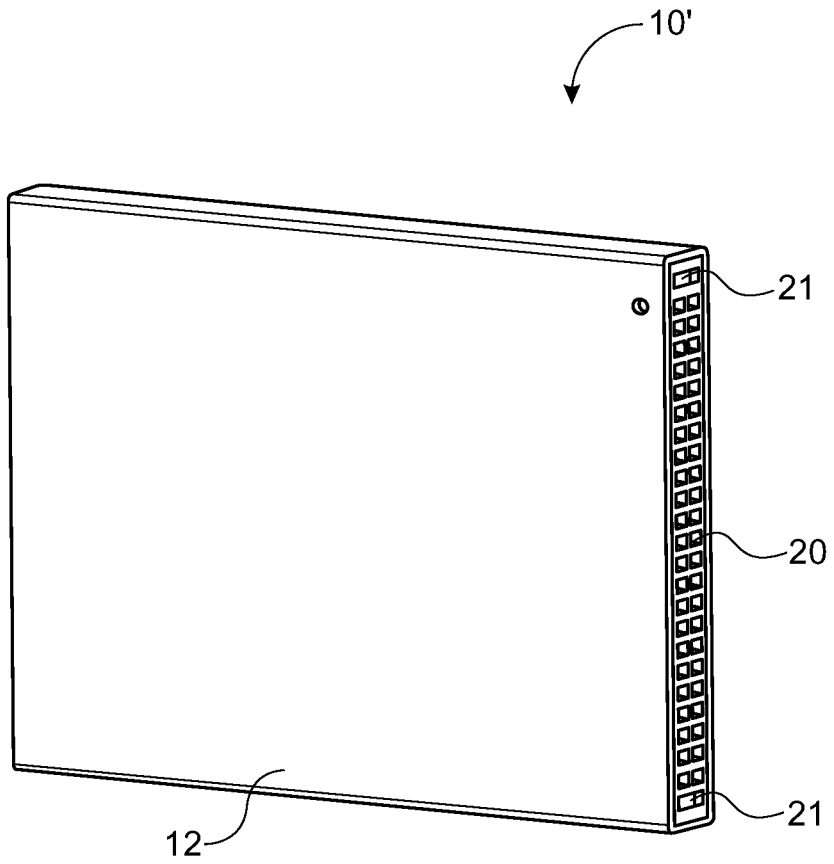
FIG. 6 is a perspective view of another weep hole insert embodying principles disclosed herein.
Figure 7:
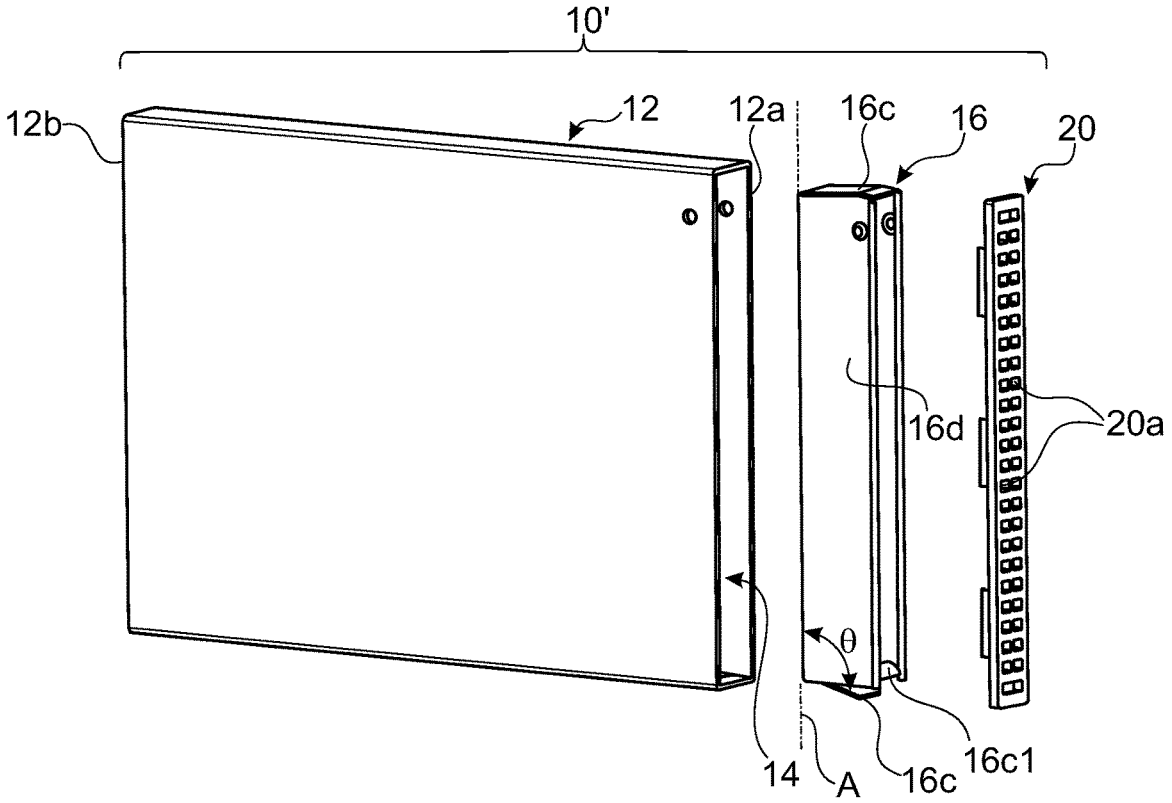
FIG. 7 is an exploded perspective view of the weep hole insert of FIG. 6.
Figure 8:
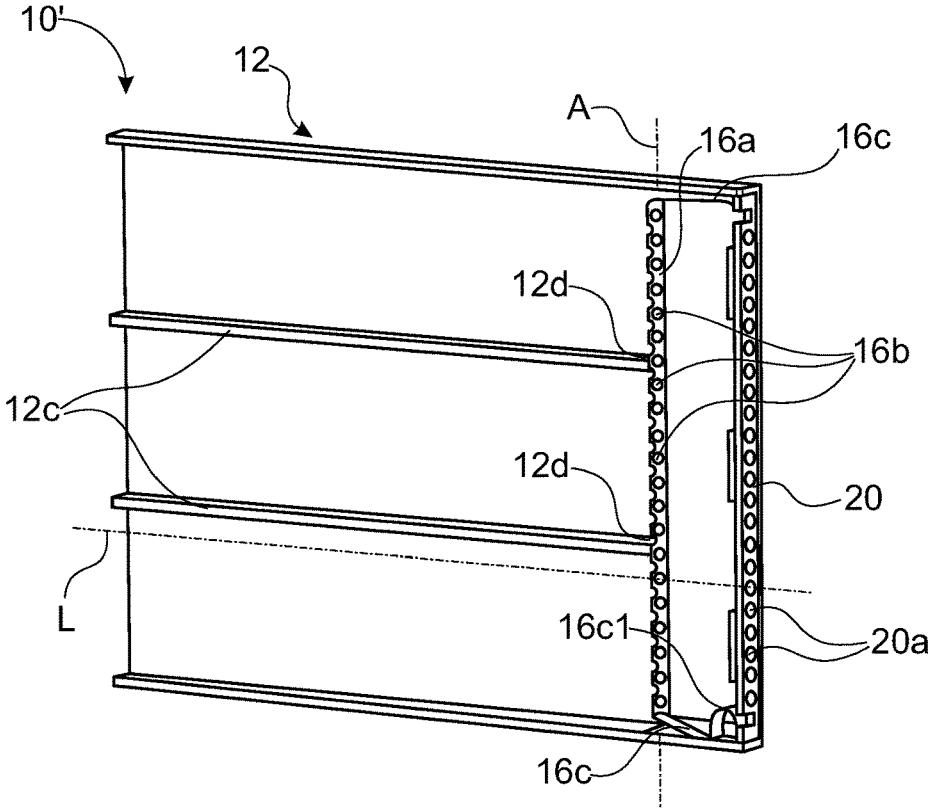
FIG. 8 is a longitudinal cross-sectional schematic view taken vertically through the weep hole insert of FIG. 6, showing the grate in a closed configuration and with its pest repellent grate in place.
Figure 9:
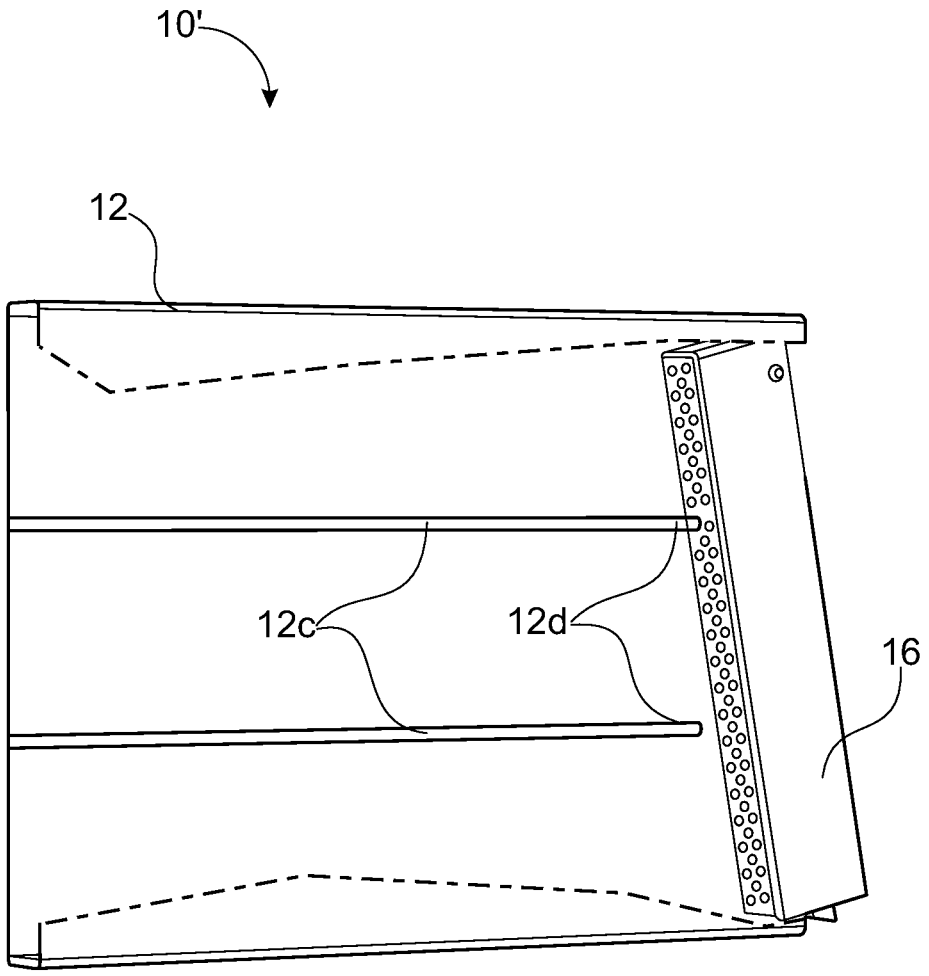
FIG. 9 is a cut-away perspective view of the weep hole insert of FIG. 6 in which a side wall of the weep hole insert is shown cut away to reveal internal features of the weep hole insert.
Figure 10:
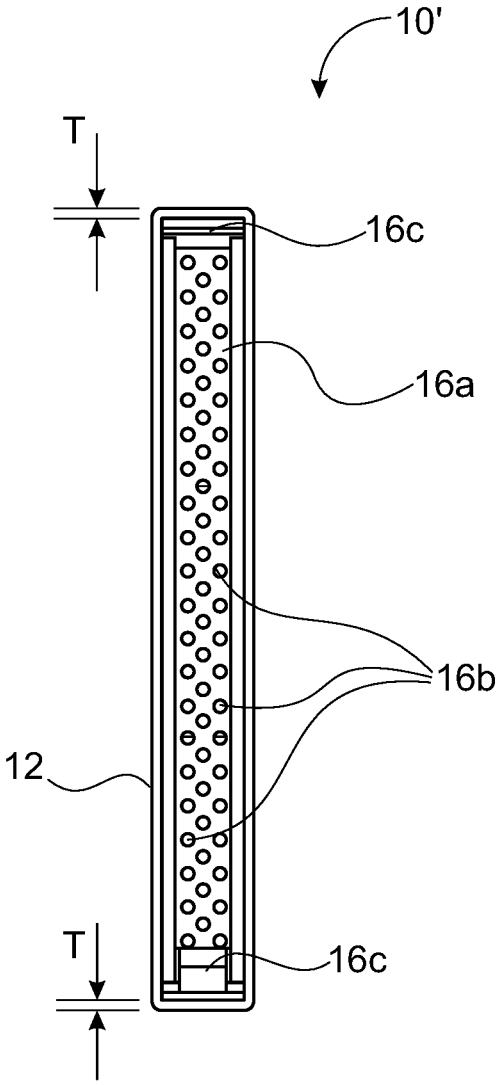
FIG. 10 is an end elevational view of the weep hole insert of FIG. 6, with its pest repellent grate removed.

A second embodiment of an insert 10' for a weep hole opening in a masonry wall is shown in FIGS. 6-10. Insert 10' has many features in common with insert 10, where corresponding reference numerals indicate corresponding features with corresponding functionality. Unless otherwise indicated, features of insert 10' that correspond with features of insert 10 are made from the same materials as those of insert 10. In insert 10', however, the orientation of grate 16 is rotated around a vertical axis by 180 degrees relative to grate 16 of insert 10. As such, in insert 10', rather than extending into tubular body 12 away from the perforated body 16*a*, as in insert 10, tabs 16*c* of insert 10' extend from perforated body 16*a* toward end 12*a* of the tubular body. Bottom tab 16*c* includes a lip 16*c*1 that is spaced from the tubular body 12 when grate 16 is in its closed configuration. As such, a lever, such as a screwdriver, can be inserted into a gap between the lip 16*c*1 and tubular body 12 to facilitate disengaging bottom tab 16*c* from the base of tubular body 12 for movement of grate 16 to the open configuration. Insert 10' also comprises a removable second grate 20, which is removably engageable with end 12*a* of the tubular body 12, outboard of grate 16. In the illustrated embodiment, grate 20 is removably engaged with tubular body 12 via grate 16 by being snap-lockingly engaged with grate 16. In other embodiments, grate 20 may be frictionally engaged with grate 16 or may be removably engaged with tubular body 12 directly rather than via grate 16. With grate 20 in place, as shown in FIGS. 6 and 8, an outer surface of grate 20 finishes substantially flush with end 12*a* of the tubular body. Grate 20 includes apertures 20*a* configured to permit air flow through the grate 20. Apertures 20*a* have a maximum diameter of approximately 2 mm Grate 20 includes a slot 21 engageable by a screwdriver or the like to facilitate its removal from the tubular body 12 for replacement. In the illustrated embodiment, grate 20 is formed from PP, but can alternatively be formed from another polymer material, such LDPE or PVC. Grate 20 is impregnated or coated with a pest repellent, such as bifenthrin or another pyrethroid, or another pest repellent chemical having a residual effect, such as disodium octaborate tetrahydrate or chlorpyrifos, or a combination of such chemicals, to deter insect pests, including termites, from approaching the grate 20 and from passing through apertures 20*a*. Grate 20 may be replaced every 2 years for continued efficacy of its pest repellent action. Whilst not shown, insert 10' may have a removable mortar guard cap similar to cap 18 of insert 10. The removable cap of insert 10' may engage the tubular body 12 in the same manner as grate 20.

The elastically compressible member 16*c* and tubular body 12 of insert 10' are configured such that, when exposed to a predetermined heat flux profile, the elastically compressible member maintains sufficient elasticity to elastically return to the expanded configuration as shown in FIG. 7. When insert 10' is used in bushfire/forest fire prone areas, the predetermined heat flux profile may approximate a heat flux profile associated with a bushfire/forest fire and may comprise radiant heat flux up to but not exceeding 40 kW/m$^2$. Insert 10' may have a Bushfire Attack Level (BAL) of A40 as determined according to Australian Standard 1530.8.1:2018. In some embodiments, the elastically compressible member 16*c* and tubular body 12 of insert 10' are configured such that, when exposed to a temperature above a melting point of material from which the tubular body is formed, the elastically compressible member maintains sufficient elasticity to elastically return to the expanded configuration as shown in FIG. 7.

It will be appreciated that the illustrated weep hole insert 10, 10' is well adapted for use in bushfire/forest fire prone areas. The weep hole insert 10, 10' also facilitates access to the wall cavity for inspections and the placement of insecticides and other treatments. The interconnectedness of the components of insert 10, 10' also reduces the risk of users losing the cap 18, grates 16, 20 or other components. Also, the planar outer surface profile of body 12 facilitates adjustment of the position of the insert 10, 10' in the weep hole opening, as well as facilitating removal of damaged weep hole inserts. In terms of advantages over the weep hole insert 1 disclosed in the present applicants' earlier International Patent Application No. PCT/AU2007/000004 (Publication No. WO2007/092985), weep hole insert 10, 10' disclosed herein may be easier to manufacture, especially with regard to installation of grate 16 in tubular body 12 compared to installation of grate 7 and screen 8 in body 2 of insert 1. Moreover, weep hole insert 10, 10' disclosed herein has a higher heat flux exposure capacity than that of insert 1.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive. Examples of such variations and/or modifications include, but are not limited to:

- rather than being hingedly connected, grate 16 may be axially slidably inserted into tubular body 12 and retained by friction and/or mechanical interlock;
- elastically compressible members, such as tabs 16*c*, may extend from all four edges of perforated body 16*a*; and/or
- reinforcing flanges 16*d*, or any other form of reinforcing formation for the perforated body 16*a*, may be omitted, or may be replaced with a different form of reinforcing formation.

The invention claimed is:

1. An insert for a weep hole opening in a wall, said weep hole insert comprising:

a generally tubular body defining an air flow conduit extending therethrough, along a first axis, from a first open end of the body to a second open end of the body, the tubular body being formed from a plastics material that has a first melting point;

a first grate comprising a perforated body, wherein apertures of the perforated body are configured to permit air flow through the grate but to inhibit passage of embers and sparks through the grate, and wherein, in an operative configuration, the perforated body extends across the conduit to permit air flow through the conduit via the apertures but to inhibit passage of embers and sparks through the conduit; and at least one elastically compressible member that extends from the perforated body and which, in the operative configuration:

engages between the perforated body and an interior surface of the tubular body to releasably secure the perforated body to the tubular body in the operative configuration, is elastically compressed from an expanded configuration to a compressed configuration by a distance of at least a wall thickness of the tubular body at its point of engagement by the elastically compressible member, the elastically compressible member:

comprises a metal that has a second melting point, the second melting point being higher than the first melting point, and comprises a metal with sufficient elasticity to elastically return to the expanded configuration when exposed to a temperature above the first melting point, such that, in the operative configuration and upon melting of the tubular body at its point of engagement by the elastically compressible member, the elastically compressible member elastically expands, through the melted tubular body, by at least the wall thickness of the tubular body at its point of engagement by the elastically compressible member.

2. The insert of claim 1, wherein the metal is steel, bronze or aluminium.

3. The insert of claim 1, wherein the metal is stainless steel.

4. The insert of claim 1, wherein the plastics material comprises polypropylene.

5. The insert of claim 1, wherein, when exposed to a predetermined heat flux profile comprising radiant heat flux up to but not exceeding a predetermined value selected from the group consisting of:

radiant heat flux up to but not exceeding 12.5 kW/m$^2$;

radiant heat flux up to but not exceeding 19 kW/m$^2$;

radiant heat flux up to but not exceeding 29 kW/m$^2$; and radiant heat flux up to but not exceeding 40 $kW/m^2$, the elastically compressible member maintains sufficient elasticity to elastically return to the expanded configuration.

6. The insert of claim 1, wherein the grate is hingedly connected to the tubular body and movable between a closed configuration, being the operative configuration in which the perforated body extends across the conduit, and an open configuration for facilitating inspection of the conduit.

7. The insert of claim 1, wherein the perforated body and the elastically compressible member are of integral, one-piece construction.

8. The insert of claim 7, wherein the elastically compressible member comprises a resilient tab extending from a periphery of the perforated body.

9. The insert of claim 1, wherein the perforated body comprises a substantially oblong sheet or plate.

10. The insert of claim 9, wherein at least one reinforcing formation extends along a major axis of the perforated body to strengthen the perforated body against bending.

11. The insert of claim 1, wherein the at least one elastically compressible member comprises a plurality of elastically compressible members, each of the elastically compressible members being associated with a respective edge of the perforated body.

12. The inert of claim 1, wherein the apertures of the perforated body have a maximum dimension of 2 mm.

13. The insert of claim 1, wherein the grate and the elastically compressible member are formed from corrosion-resistant metal.

14. The insert of claim 1, comprising a cap removably engageable with an end the tubular body, outboard of the grate, to close the conduit and cover the perforated body.

15. The insert of claim 14, wherein the cap is removably engageable with the grate and thereby with the tubular body.

16. The insert of claim 1, wherein the plastics material comprises a flame retardant material.

17. The insert of claim 1, wherein the plastics material comprises a pesticide.

18. The insert of claim 1, comprising a second grate removably engageable with an end the tubular body, outboard of the first grate, the second grate carrying a pesticide.

19. The insert of claim 18, wherein the second grate is removably engageable with the first grate and thereby with the tubular body.

* * * * *